US005960982A

United States Patent [19]

Perlis et al.

[11] Patent Number: 5,960,982

[45] Date of Patent: Oct. 5, 1999

[54] COMBINATION BUFFET PLATE AND CUP HOLDER

[76] Inventors: Robert Perlis, 1105 Del Mar Ave., Santa Barbara, Calif. 93109; Thomas Prusinski, 854 Maple Ave., Carpinteria, Calif. 93013

[21] Appl. No.: 09/094,352

[22] Filed: Jun. 9, 1998

Related U.S. Application Data

[62] Division of application No. 08/905,465, Aug. 4, 1997.

[51] Int. Cl.[6] ..... B65D 1/36

[52] U.S. Cl. ..... 220/574; 220/23.8; 220/23.83; 206/558; 206/564

[58] Field of Search ..... 220/574, 23.8, 220/23.83, 23.86; 200/558, 564

[56] References Cited

U.S. PATENT DOCUMENTS

| | | | |
|---|---|---|---|
| 3,883,029 | 5/1975 | Wyatt | 220/23.83 |
| 3,955,672 | 5/1976 | Brundagg | 220/23.56 |
| 4,219,144 | 8/1980 | Hagelberg | 200/563 |
| 4,732,274 | 3/1988 | Bouton | 220/23.83 |
| 4,867,331 | 9/1989 | Task | 220/23.8 |
| 5,207,743 | 5/1993 | Costarella et al. | 220/574 |
| 5,249,700 | 10/1993 | Dumke | 220/574 |
| 5,441,164 | 8/1995 | Beck et al. | 220/574 |
| 5,634,568 | 6/1997 | Wawrzynak | 220/574 |

*Primary Examiner*—Joseph M. Moy
*Attorney, Agent, or Firm*—Larry Baker

[57] ABSTRACT

A combined plate and cup holder incorporates an integral cup holder, the bottom surface of which serves as a convenient means of holding the plate. Access to the bottom surface of the cup holder is enhanced with a raised hand passthrough element connecting the rim of the plate to the cup holder, which also serves to lower the center of gravity of the plate with respect to the diner's hand, thereby facilitating the balance of the plate on the diner's hand and increasing security and comfort. The lower surfaces of the plate and cup holder are substantially coplanar, allowing the plate to rest stably on a flat surface. The cupholder extends above the rim of the plate, providing increased stability for a cup or beverage can. Both full-size and small embodiments of the buffet plate are presented, with the full-size plate having the cupholder positioned near the center of the plate for improved comfort and balance. The small embodiment has the cup holder positioned near the edge of the plate with a shortened hand passthrough element to maximize the available food area of the plate.

8 Claims, 4 Drawing Sheets

COMBINATION BUFFET PLATE AND CUP HOLDER

RETLATED APPLICATION

This is a Divisional Application of copending U.S. application Ser. No. 08/905,465 which was filed on Aug. 4, 1997.

TECHNICAL FIELD

This invention relates to an improved combination buffet plate and cup holder, in which enhanced convenience is achieved with an easily-grasped integral cup holder and a raised hand pass-through element.

BACKGROUND OF THE INVENTION

A common problem encountered at social gatherings such as picnics, parties, and receptions where food is served while the guests are standing is the difficulty of holding both a plate of food and a beverage, while at the same time keeping a hand free with which to eat. Often diners will resort to setting down their beverage on any nearby flat surface, or will awkwardly try to hold both their plate and cup in the same hand.

Over the years many variations of combination plate and cup holders have been designed seeking to address this problem. The basic goals that designers have attempted to meet are the need for an easily-held plate that securely retains a cup or beverage can, but which is not top heavy, can be sat on a flat surface if desired, and is inexpensive to manufacture and ship. Existing designs all fail to meet at least one of these goals.

An example of an early design is Leppke (U.S. Pat. No. 2,107,381), which discloses a "dutch lunch" plate having a central cup holder with food compartments arranged radially around the cup holder. In Leppke, the cup is placed significantly above the plane of the plate, making the combination of a full plate of food and a full cup top heavy with a significant potential for tipping and spillage. The plate in Leppke is also no easier to hold than a standard dinner plate; a diner has the choice of holding it from the edge, with a thumb in one of the food compartments, or of resting it precariously in the palm of one hand.

A more recent design, Beck (U.S. Pat. No. 5,441,164), discloses an improvement over Leppke. In Beck, the center of gravity of the combined plate and cup is lowered by providing cutout in the central cup holder for the handle of a cup, allowing a coffee cup or other cup having a handle to sit deeper in the cupholder and therefore closer to the plate, and to be more firmly retained than in Leppke. Beck, however, did not address the problem of making the plate itself easier to hold.

Designers have followed several different approaches in seeking to develop an easily held combination plate and cup holder. Raiser (U.S. Pat. No. 2,240,020) from 1937 shows a combined plate and cup holder in which the cup holder extends below the plate, giving the diner a more convenient and stable means of holding the plate. The Raiser design is also stackable, although a separate spacer element in the cup holder must be removed before stacking. Albeit more convenient for a standing diner, the Raiser plate cannot be stably rested on a flat surface, particularly if loaded with food, due to the small base of the cup holder. A more recent patent, Patterson, et al. (U.S. Pat. No. 5,292,028) discloses a similar concept, in which a common beverage can may be attached to the bottom of a plate, the beverage can thus serving as a means of holding both the can and the plate. Patterson requires that the diner drink through a straw, however, and would have similar stability problems as Raiser when rested on a flat surface.

A different approach is disclosed by Harper (U.S. Pat. No. 4,461,396), in which a hole is provided in the plate, allowing the combined plate and glass holder to be grasped like an artist's palette, with the diner's thumb placed through the hole with the rest of the diner's hand placed beneath the plate. The diner's thumb can rest on the base of a stemware glass placed in the shallow cupholder, providing somewhat tenuous support for the glass. A similar design is used in Sampson (Des. U.S. Pat. No. 366,817), which physically resembles an artist's palette, and incorporates a second hole into which a tapered cup may be placed.

Yet a third approach is disclosed in Donche (U.S. Pat. No. 5,353,952), which utilizes a sleeve on the bottom of the plate, into which the diner places his fingers, thus "wearing" the plate in a similar manner to a baseball catcher's mitt. The Donche design succeeds in providing a more stable means of holding the plate, but trades off ease of manufacture and storage, since the design comprises several assembled pieces and is not stackable.

In addition to providing a secure means to hold a cup or beverage can and being easy to hold, simplicity of manufacture is important. Designs consisting of an assemblage of separate parts, or having complex shapes, may be prohibitively expensive to manufacture. In many social situations it is desirable that the plates, cups, and dinnerware used by guests be disposable, both to save the cost of cleanup and because the social event may be a one-time event and no reuse of the items is contemplated. To provide a combined plate and cup holder that is affordable to the consumer as a disposable item, it is important that it be simple to manufacture, and that the items "nest" together compactly for shipping, storage, and sale.

SUMMARY OF THE INVENTION

It is an objective of the present invention to provide an improved combination plate and cup holder which is more convenient for the diner than existing designs, and which is also simple to manufacture.

The combined plate and cup holder of the present invention incorporates an integral cup holder, the bottom surface of which serves as a convenient means of holding the plate. Access to the bottom surface of the cup holder is enhanced with a raised hand passthrough element connecting the rim of the plate to the cup holder, which also serves to lower the center of gravity of the plate with respect to the diner's hand, thereby facilitating the balance of the plate on the diner's hand and increasing security and comfort. The lower surfaces of the plate and cup holder are substantially coplanar, allowing the plate to rest stably on a flat surface. The cupholder extends above the rim of the plate, providing increased stability for a cup or beverage can.

Both full-size and small embodiments of the buffet plate are presented, with the full-size plate having the cupholder positioned near the center of the plate for improved comfort and balance. The small embodiment has the cup holder positioned near the edge of the plate with a shortened hand passthrough element to maximize the available food area of the plate.

It is the further objective of the present invention to provide a design which can be easily and inexpensively manufactured as a single piece, and which can stack or "nest" together in an efficient manner for shipping, storage, and selling, thus reducing the cost to the consumer. In the preferred embodiment this is achieved with a plate cross section which lends itself to simple manufacturing methods such as molding or stamping.

BRIEF DESCRIPTION OF THE DRAWINGS

The invention is further described in connection with the accompanying drawings, in which.

DESCRIPTION OF THE PREFERRED EMBODIMENT

Figure 1:
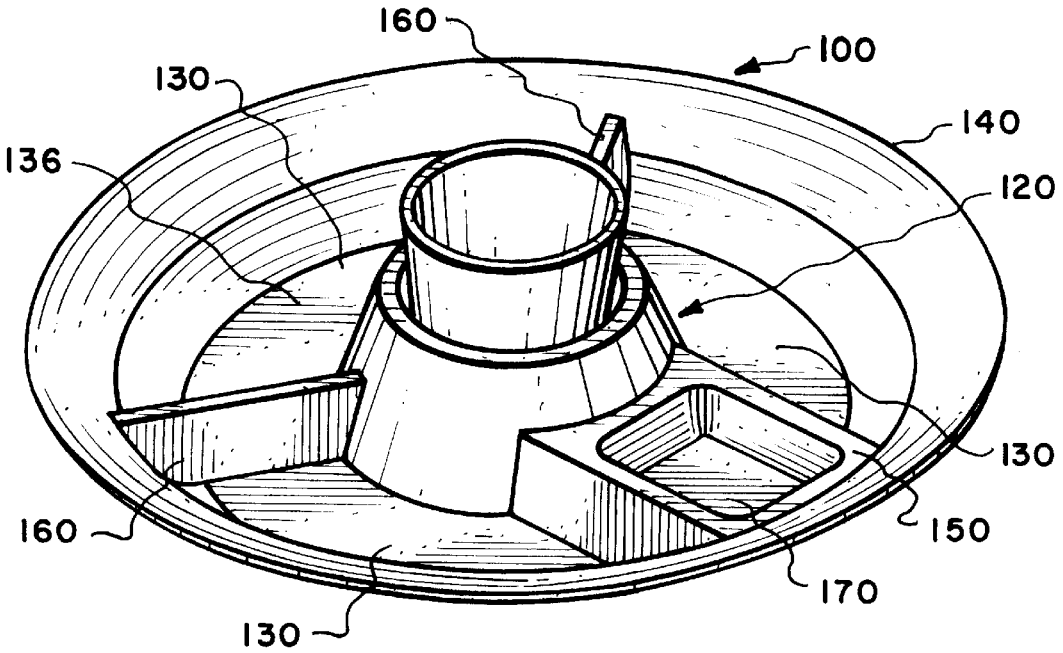
FIG. 1 is a perspective view of the full-size combination buffet plate and cup holder.
Figure 2A:
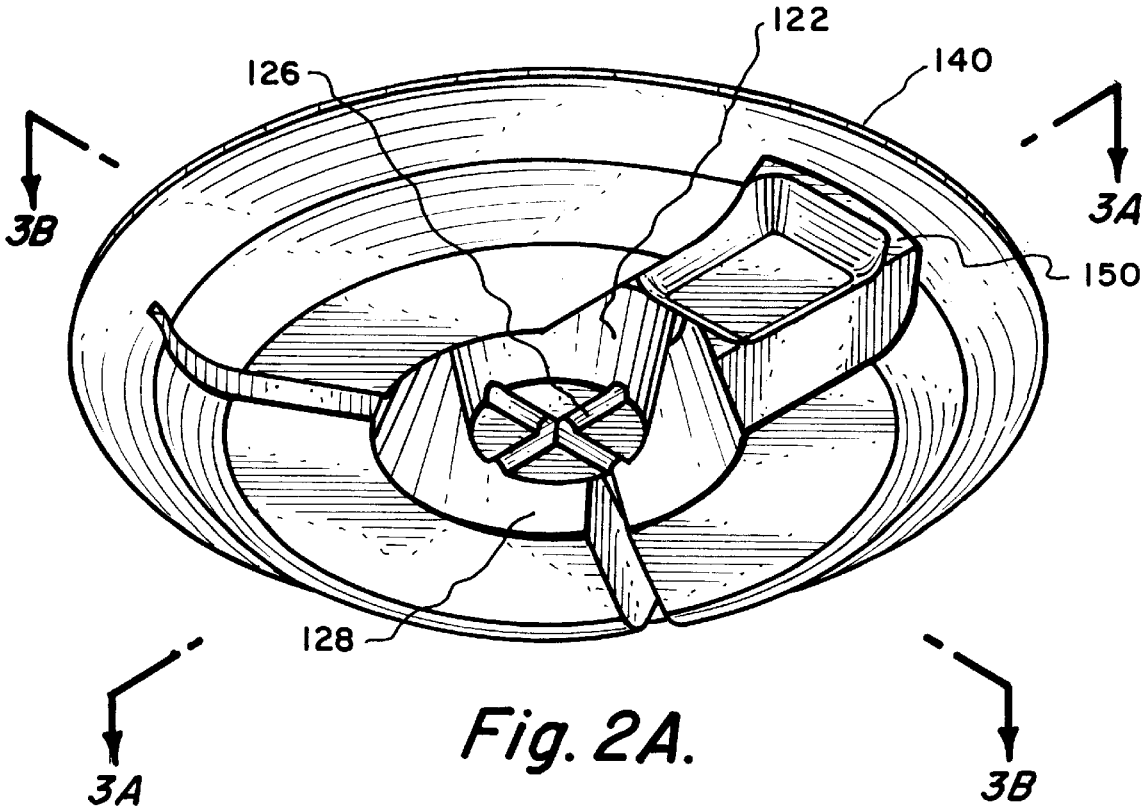
FIG. 2*a* is a perspective view from beneath the full-size combination buffet plate and cup holder.
Figure 2B:
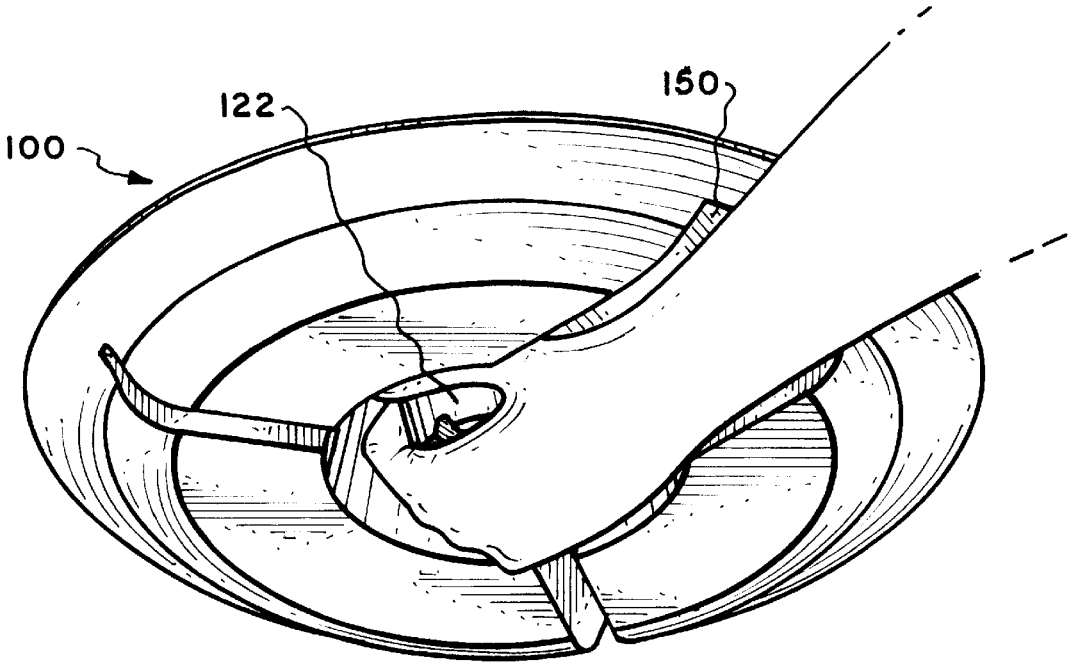
FIG. 2*b* is a perspective view from beneath the full-size combination buffet plate and cup holder, indicating the manner in which it is held by a diner.

As shown in FIG. 1, the preferred embodiment of the full-size improved buffet plate and cup holder is an essentially round plate 100 with an integral cup holder 120 positioned near the center of the plate, although in other embodiments of the invention the plate may vary in shape and the cup holder may be offset from the center of the plate. The preferred embodiment is shown with three food pockets 130; other embodiments may have other arrangements of food pockets, including a single food pocket. The plate has a raised outer rim 140 which serves to stiffen the plate and in the preferred embodiment forms the outer wall of the food pockets. The integral hand passthrough support 150 connects the raised outer rim 140 to the cup holder 120 such that the plate may be rested on the wrist and hand of the diner with the diner's fingers lightly grasping the outer surface 122 of the cup holder (FIGS. 2*a* and 2*b*). The raised hand passthrough support in combination with the cup holder on the underside of the plate serves to lower the center of gravity of the plate with respect to the hand of the diner, thereby reducing the likelihood of tipping or spillage.

Figure 3A:
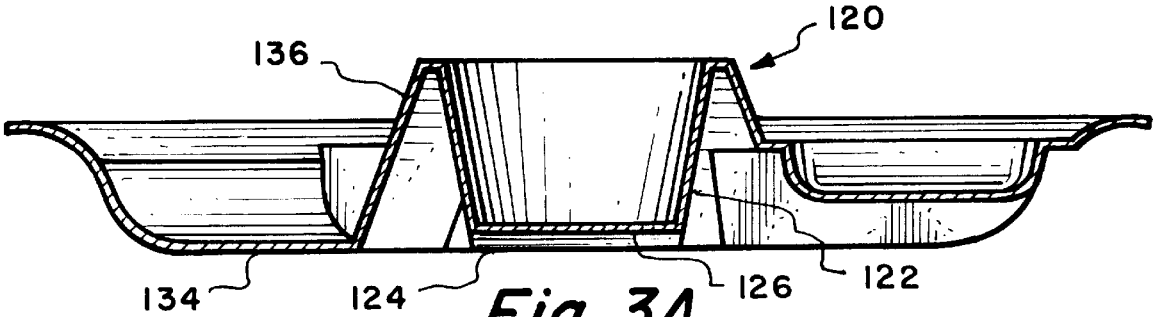
FIG. 3*a* is a section view of the full-size plate along the axis of the hand passthrough and cup holder.
Figure 3B:
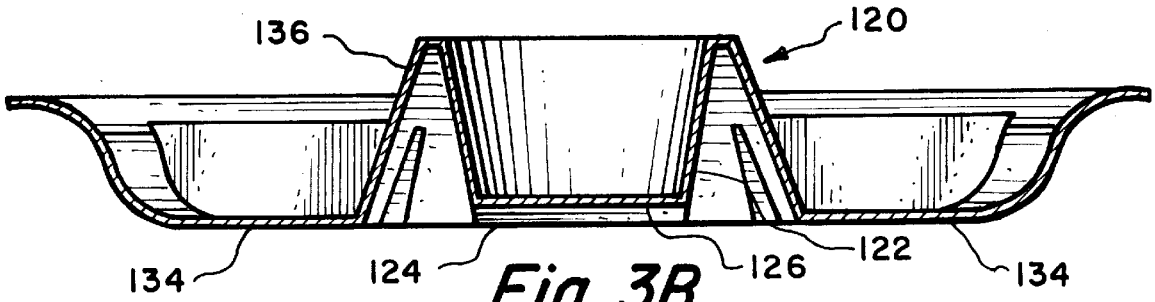
FIG. 3*b* is a section view of the full-size plate perpendicular to the axis of the hand passthrough and cup holder.

The cup holder 120 of the preferred embodiment is circular in horizontal cross section, narrowing in diameter from top to bottom to allow a variety of cup sizes to used with the plate. The diameter at the bottom of the cup holder is sized to accommodate a standard aluminum beverage can. The cup holder is of sufficient depth that a significant part of the lower portion of the cup is retained, reducing the potential for accidental tipping. As shown in FIGS. 3*a* and 3*b*, the bottom surface 124 of the cup holder 120 is essentially coplanar with the bottom surfaces 134 of the food pockets 130, allowing the plate to rest stably on a flat surface. The bottom of the cup holder in the preferred embodiment has a plurality of ribs 126 which raise the bottom of the cup slightly above the bottom of the cupholder; the ribs, together with the wall of the cup holder, form small wells to retain any residual fluids that might otherwise adhere to the cup and be carried onto the user's clothing or person. The ribs 126 also serve to strengthen the cup holder bottom.

The inner walls 136 of the food pockets 130 adjacent to the cup holder 120 are spaced sufficiently away from the cup holder to allow adequate room for the diner's fingers to grasp the outer surface 122 of the cup holder. In the preferred embodiment this is achieved by sloping the inner walls of the food pockets at a shallower angle than would otherwise be required.

The preferred embodiment of the plate is divided by a plurality of stiffening ribs 160 into multiple food pockets 130; in FIG. 1 two stiffening ribs are shown, creating in combination with the hand passthrough support 150 three food pockets 130. Although in the preferred embodiment the stiffening ribs run radially from the cup holder to the outer rim of the plate, various other arrangements of stiffening ribs are possible, creating different arrangements of food pockets; or the ribs may be omitted in an embodiment having a single food pocket.

The preferred embodiment also has one condiment pocket 170 on the upper surface of the hand passthrough support, both for the convenience of the diner and to stiffen the hand passthrough support. Other embodiments of the plate may include a plurality of condiment pockets, or the condiment pocket may be omitted.

Figure 4:
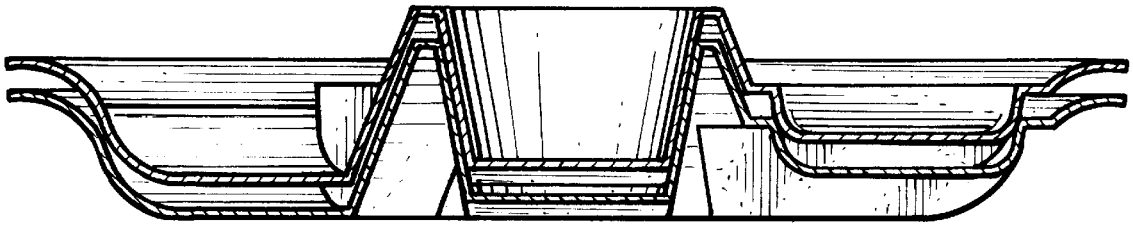
FIG. 4 is a section view of the full-size plate along the axis of the passthrough and cup holder, indicating how the plates may nested for shipping, storage, and sale.

It is a further feature of the preferred embodiment that the plates may be "nested" or stacked, as shown in cross section in FIG. 4. Each additional plate on the stack adds only slightly to the height of the stack, thus facilitating shipping and storage of the plates.

Figure 5:
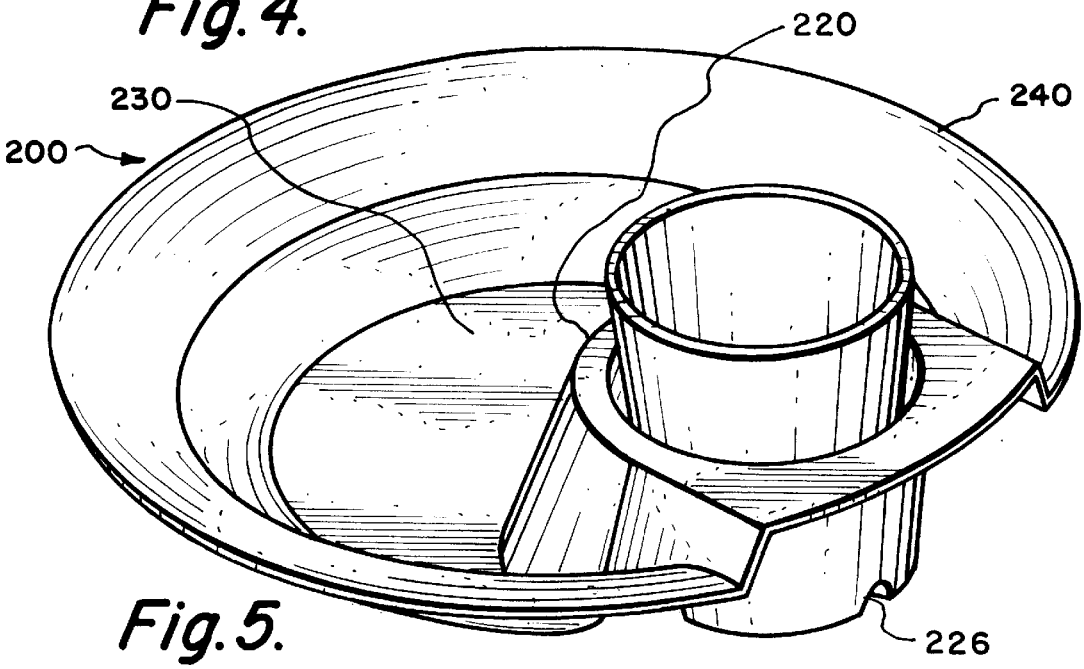
FIG. 5 is a perspective view of the small combination buffet plate and cup holder.

As shown in FIG. 5, the preferred embodiment of the small combination buffet plate and cup holder is an essentially round plate 200 with an integral cup holder 220 positioned near the edge of the plate, although in other embodiments of the invention the plate may vary in shape and the cup holder may be differently placed. In the small version of the plate, it is to be recognized that the cup and its contents represent the most significant part of the weight on the diner's hand, and placing the cup holder near the edge of the plate therefore does not result in a discomfort to the user, while at the same time making the plate easier to grasp while it is sitting on a flat surface and also maximizing the area of the food pocket 230. The small plate is intended for situations in which small amounts of food are served with a drink, such as hors d'oeuvres at a reception.

The preferred embodiment of the small plate is shown with a single food pocket 230, which is the most practical configuration given the limited area on the plate, but other configurations are possible by dividing the plate with stiffening ribs (not shown) to create a plurality of food pockets or condiment pockets. The plate has a raised outer rim 240 which serves to stiffen the plate and in the preferred embodiment forms the outer wall of the food pocket.

Figure 6A:
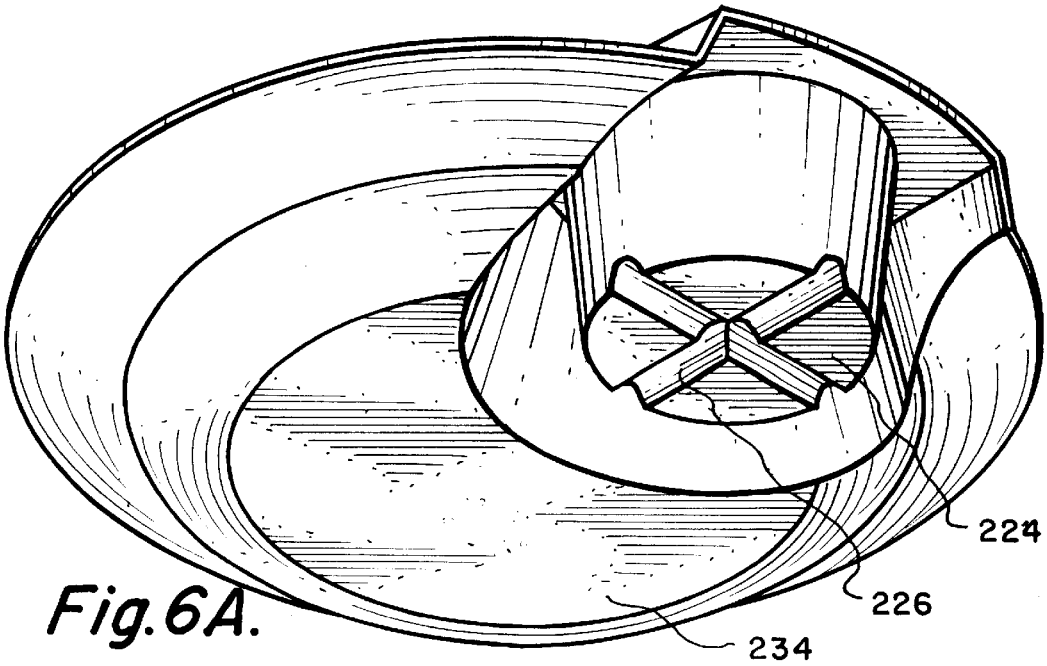
FIG. 6*a* is a perspective view from beneath the small combination buffet plate and cup holder.
Figure 6B:
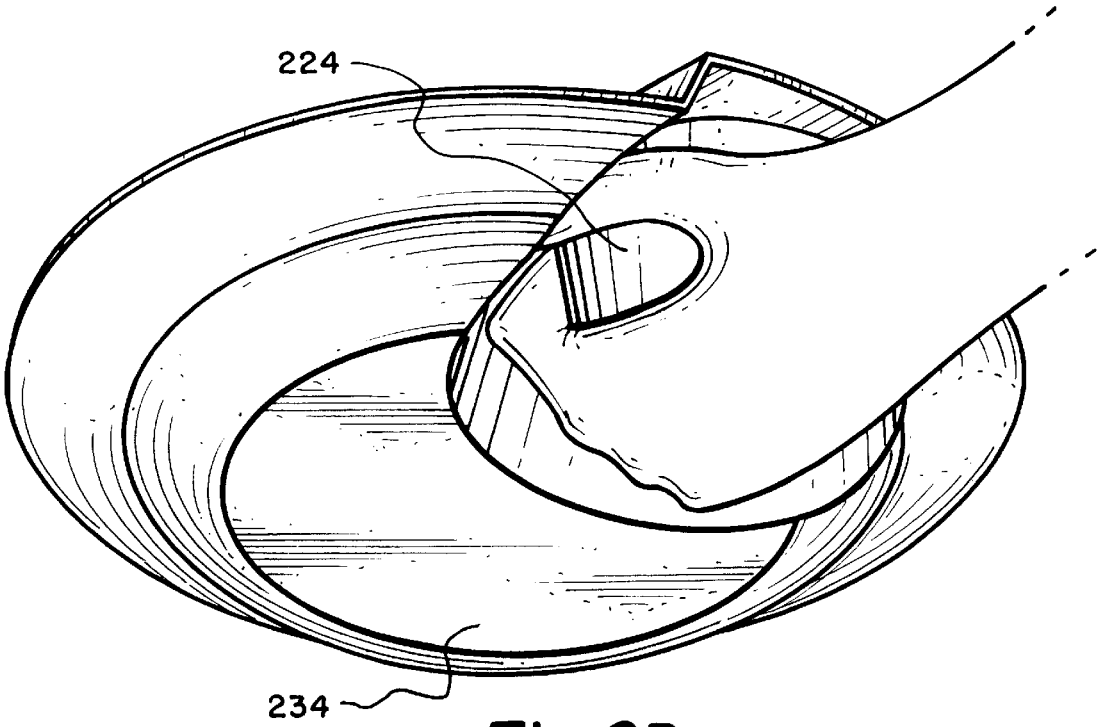
FIG. 6*b* is a perspective view from beneath the small combination buffet plate and cup holder, indicating the manner in which it is held by a diner.

The cup holder 220 of the preferred embodiment of the small plate is circular in horizontal cross section, narrowing in diameter from top to bottom to allow a variety of cup sizes to used with the plate. The diameter at the bottom of the cup holder is sized to accommodate a standard aluminum beverage can. The cup holder is of sufficient depth that a significant part of the lower portion of the cup is retained, reducing the potential for accidental tipping. As shown in FIGS. 6*a* and 6*b*, the bottom surface 224 of the cup holder 220 is essentially coplanar with the bottom surfaces 234 of the food pocket 230, allowing the plate to rest stably on a flat surface. The bottom of the cup holder in the preferred embodiment has a plurality of ribs 226 which raise the bottom of the cup slightly above the bottom of the cup-holder; the ribs, together with the wall of the cup holder, form small wells to retain any residual fluids that might otherwise adhere to the cup and be carried onto the user's clothing or person. The ribs 226 also serve to strengthen the cup holder bottom.

Figure 7:
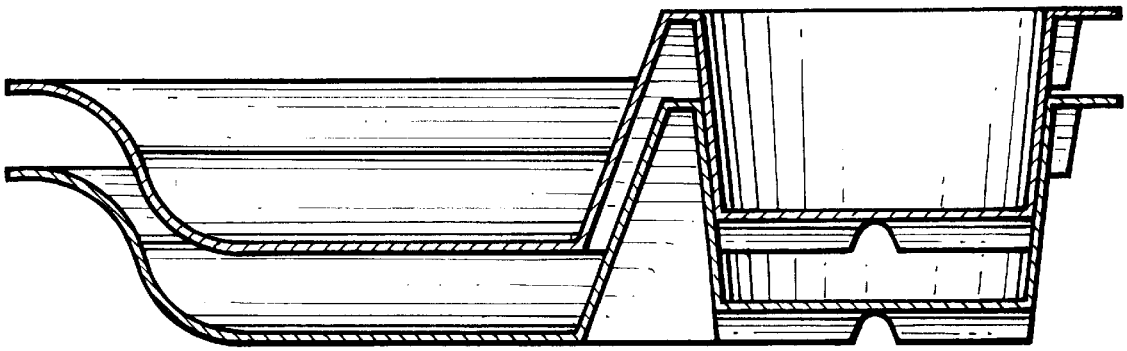
FIG. 7 is a section view of the small plate along the axis of the cup holder, indicating how the plates may nested.

It is a further feature of the preferred embodiment that the small buffet plates may be "nested" or stacked, as shown in cross section in FIG. 7. Each additional plate on the stack adds only slightly to the height of the stack, thus facilitating shipping and storage of the plates.

The preferred embodiments of both the full-size and small buffet plates are formed from an inexpensive rigid or semi-rigid material, such as stiff cardboard or a plastic material such as polystyrene, making the plate disposable. In other embodiments, a reusable plate may be constructed of a higher grade plastic material, metal such as aluminum or stainless steel, or other rigid material.

Although specific embodiments of full-size and small combination buffet plate and cup holders are disclosed, it is the applicant's intent that the invention claimed include any design variations which incorporate the combination of an integral cupholder having a graspable lower surface, a hand passthrough element from the rim of the plate to the integral cup holder, and essentially coplanar bottom surfaces of the plate and integral cupholder.

What is claimed is:

1. A combination buffet plate and cup holder, comprising:

a) a buffet plate formed of a thin, rigid material having a food-receiving upper surface, a lower surface, a center area and an outer edge;

b) a cup holder formed integrally in the center area of said buffet plate and having an outer wall, a top rim, an inner wall, and a bottom; said outer wall, top rim, inner wall and bottom all having upper and lower surfaces; the upper surfaces of the inner wall and bottom forming a compartment to receive and firmly support a drinking cup or standard beverage can; the inner wall and bottom approximating the shape of a drinking cup, with the diameter of said compartment adjacent to the bottom compatible for holding a standard beverage can; the top rim forming an annular ring spacing the outer wall away from the inner wall; the outer wall sloping away from the inner wall so as to provide space between the inner and outer walls for a diner's hand; the outer wall further having a gap providing access for the diners hand; the lower surface of the cup holder bottom being substantially coplanar with the lower surface of the buffet plate, whereby the combination buffet plate and cup holder can sit stably on a flat surface;

c) a raised outer rim integral with the outer edge of said buffet plate surface serving to retain food on the plate and to stiffen the plate, having a gap providing access to said cup holder for a diner's hand;

d) a hand passthrough and support segment integral with and extending above the buffet plate food-receiving surface, having two side walls and a raised center section; said side walls and raised center section all having upper and lower surfaces; said hand passthrough support aligned with the gap in the raised outer rim and the gap in the outer wall of the cup holder, with said side walls connecting with the outer wall of the cup holder on either side of the gap; the lower surfaces of said side walls and raised center section providing a resting surface for the wrist and hand of a diner when the cup holder is grasped by the diner, whereby the center of gravity of the plate when held by the diner is lowered, reducing the potential for spillage.

2. The combination buffet plate and cup holder of claim 1, wherein the buffet plate further comprises one or more dividing ribs integral with and extending above the buffet plate food receiving surface, whereby the buffet plate is stiffened and is divided into a plurality of discrete food pockets.

3. The combination buffet plate and cup holder of claim 1, wherein the hand passthrough and support further comprises one or more condiment pockets integrally formed in said raised center section, whereby convenience to the diner is increased and the hand passthrough segment is strengthened.

4. The combination buffet plate and cup holder of claim 1, wherein the cup holder further comprises bottom ribs integrally formed in the cup holder bottom; said bottom ribs together with the cup holder bottom and cup holder sides forming small fluid wells, whereby a cup placed in the cup holder is raised above any residual fluid in the cup holder and the cup holder bottom is strengthened.

5. The combination buffet plate and cup holder of claim 1, wherein the plate material comprises stiff cardboard, whereby the buffet plate and cup holder are disposable.

6. The combination buffet plate and cup holder of claim 1, wherein the plate material comprises an inexpensive plastic material, whereby the plate and cup holder are disposable.

7. The combination buffet plate and cup holder of claim 1, wherein the plate material comprises a durable plastic material, whereby the plate and cup holder are reusable.

8. The combination buffet plate and cup holder of claim 1, in which the plate material comprises sheet metal, whereby the plate and cup holder are reusable.

* * * * *